US007473125B2

(12) United States Patent
Murakami

(10) Patent No.: US 7,473,125 B2
(45) Date of Patent: Jan. 6, 2009

(54) ELECTRICAL CONNECTOR

(75) Inventor: Haruhiko Murakami, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/826,740

(22) Filed: Jul. 18, 2007

(65) Prior Publication Data

US 2008/0020616 A1 Jan. 24, 2008

(30) Foreign Application Priority Data

Jul. 18, 2006 (JP) ..... 2006-195201

(51) Int. Cl.
*H01R 12/24* (2006.01)

(52) U.S. Cl. ..... 439/495; 439/260

(58) Field of Classification Search ..... 439/495, 439/492, 493, 494, 260
See application file for complete search history.

(56) References Cited

U.S. PATENT DOCUMENTS

| | | | | |
|---|---|---|---|---|
| 4,172,626 | A | 10/1979 | Olsson | |
| 7,083,464 | B2 * | 8/2006 | Liu et al. | 439/495 |
| 7,094,093 | B2 * | 8/2006 | Nakano et al. | 439/495 |
| 7,134,891 | B2 * | 11/2006 | Kayama et al. | 439/260 |
| 2003/0220013 | A1 * | 11/2003 | Lee | 439/495 |
| 2003/0232536 | A1 * | 12/2003 | Saito et al. | 439/495 |
| 2004/0097118 | A1 * | 5/2004 | Takashita | 439/327 |
| 2006/0052000 | A1 | 3/2006 | Liu et al. | |

FOREIGN PATENT DOCUMENTS

| | | |
|---|---|---|
| JP | 07-016384 U | 3/1995 |
| JP | 2004-165046 | 6/2004 |
| JP | 2005-116495 | 4/2005 |

OTHER PUBLICATIONS

European Search Report, Nov. 21, 2007.

* cited by examiner

*Primary Examiner*—Hien Vu
(74) *Attorney, Agent, or Firm*—Kubotera & Associates, LLC

(57) ABSTRACT

An electrical connector is connected to a flat conductive member having a connecting portion. The electrical connector includes a housing formed of an insulating material and having a receptacle space for receiving the flat conductive member; a terminal arranged in the housing along a first direction; a metal member disposed in the housing, said metal member including an attaching portion attached to the housing, an arm portion extending from the attaching portion, and an extending portion extending inward from the arm portion; and a pressing member supported on one of the housing, the terminal, and the metal member to be rotatable for pressing a contact portion of the terminal against the connecting portion. The extending portion extends close to the flat conductive member and overlaps with the flat conductive member when the flat conductive member is inserted into the receptacle space.

5 Claims, 5 Drawing Sheets

ELECTRICAL CONNECTOR

BACKGROUND OF THE INVENTION

The present invention relates to an electrical connector to be connected to a flat conductive member.

A flat conductive member includes a flexible print circuit board (FPC), a flat cable, and the likes. In many cases, such a flat conductive member is connected to an electrical connector attached to a circuit board.

In the flat conductive member, a reinforcing sheet is attached to a surface thereof opposite to a connecting portion to be connected to a connector at a distal end portion of the flat conductive member. An engaging step portion such as an ear portion and a cut recess portion is disposed on both side edges of the reinforcing sheet, thereby preventing the flat conductive member from coming off from the connector more effectively.

Patent Reference 1 has disclosed a connector having a housing with a receptacle space for receiving a flat conductive member. A protruding portion is disposed in the receptacle space on both side edges in a direction that terminals are arranged. The protruding portion is integrated with the housing as part of the housing. When a connecting portion of the flat conductive member is inserted into the receptacle space by a specific distance, the protruding portion engages an ear portion protruding from a side edge of the flat conductive member.

In use, the connecting portion of the flat conductive member is inserted frontward into the receptacle space. The ear portion moves over the protruding portion, and the connecting portion of the flat conductive member enters the receptacle space, so that the connecting portion is situated over a contact portion of the terminals arranged in the receptacle space. At the position, a backside surface of the ear portion faces a front surface of the protruding portion. Accordingly, when the flat conductive member is inadvertently pulled in a pullout direction, the ear portion engages the protruding portion along the same direction, thereby preventing the flat conductive member from pulling out. In the connector disclosed in Patent Reference 1, a movable pressing portion is provided for strongly pressing the flat conductive member against the contact portion of the terminals.

Patent Reference 1: Japanese Patent Publication No. 2005-116495

In the electrical connector, the flat conductive member is integrated with fine conductive members arranged in a flexible band shape with a fine pitch. Correspondingly, the terminals are arranged with a fine pitch. Accordingly, the connector has a small size in the direction that the terminals are arranged.

In the connector disclosed Patent Reference 1, the protruding portion for engaging the ear portion of the flat conductive member is integrated with the housing. That is, the protruding portion is formed of a material same as that of the housing. Accordingly, the protruding portion needs to have a sufficient size in order to withstand a pullout force when the flat conductive member is inadvertently pulled out. The protruding portion is disposed adjacent to the side edge of the flat conductive member. Accordingly, when the size of the protruding portion increases, the size of the connector increases by the inclement in the direction that the terminal are arranged, thereby making it difficult to reduce the size in the direction.

In view of the problems described above, an object of the invention is to provide an electrical connector for connecting a flat conductive member. In the present invention, the electrical connector has a small size and easy to produce.

Further objects of the invention will be apparent from the following description of the invention.

SUMMARY OF THE INVENTION

According to the present invention, an electrical connector is provided for connecting a flat conductive member. In the electrical connector, a plurality of terminals is arranged in a housing formed of an insulating material. The housing has a receptacle space for receiving the flat conductive member. The terminals have a contact portion arranged in the housing for contacting with a connecting portion of the flat conductive member to be inserted into the receptacle portion. The housing further includes a metal member at an end portion thereof in a direction that the terminals are arranged. After the connecting portion of the flat conductive member is placed at the contact portion, when a movable member supported on one of the housing, the terminals, and the metal member to be rotatable is moved to a specific position, the connecting portion of the flat conductive member is pressed against the contact portion of the terminals.

In the electrical connector for the flat conductive member, the metal member includes an attaching portion to be attached to the housing; an arm portion extending in parallel to a side end surface of the flat conductive member from the attaching portion outside a range where the terminals are arranged; and an extending portion extending inward from the arm portion in the direction that the terminals are arranged. The extending portion extends near a side edge portion of the flat conductive member. Further, the extending portion overlaps with the flat conductive member in a thickness direction of the flat conductive member.

In the electrical connector of the present invention having the configuration described above, the extending portion overlaps with the flat conductive member in a thickness direction of the flat conductive member. Accordingly, in a case that an engaging step portion such as an ear portion or a recess portion is formed on the side edge portion of the flat conductive member, when the flat conductive member is inadvertently pulled backward, i.e., a pullout direction, after the flat conductive member is placed at a specific position, a front surface of the extending portion abuts against a corresponding surface of the engaging step portion within an overlapping range in the thickness direction of the flat conductive member, thereby preventing the flat conductive member from pulling out.

The extending portion is formed of a metal material and has a sufficient strength. Accordingly, it is possible to withstand an inadvertent force in the pullout direction without increasing a size of the extending portion in both an extending direction and a thickness direction of the extending portion. As a result, even when the extending portion extend near both of edge portions of the flat conductive member, it is not necessary to increase a size of the connector in the direction that the terminals are arranged. Further, the extending portion overlaps with the flat conductive member in the thickness direction, so that it is not necessary to increase a size of the connector in the thickness direction as well.

In the present invention, the metal member is formed of a metal plate. A plate surface of the arm portion may extend in parallel to the side end surface of the flat conductive member. A plate surface of the extending portion may extend in parallel to a surface of the connecting portion of the flat conductive member. That is, a size of the arm portion in the direction that the terminals are arranged is equal to a thickness of the metal plate. Further, a size of the extending portion in the thickness direction of the flat conductive member is also equal to the thickness of the metal plate. With a small thickness of the metal plate, it is not necessary to increase the size of the connector. Further, the extending portion receives a force from the flat conductive member in a direction parallel to the plate surface, thereby providing sufficient strength and rigidity against the force.

The extending portion preferably includes an engaging surface. The engaging surface includes a surface in parallel to a corresponding surface of the engaging step portion, and the surface overlaps with the engaging step portion in the thickness direction of the flat conductive member. As described above, the engaging step portion may include the ear portion protruding from the side edge portion of the flat conductive member or the recess portion formed in the side edge portion of the flat conductive member. With the configuration describe above, the engaging surface of the extending portion contacts with the engaging step portion of the flat conductive member. Accordingly, when the flat conductive member is inadvertently pulled out with a relative large force, the engaging surface and the corresponding surface of the engaging step portion receive a relatively small force.

When the engaging step portion includes the ear portion, the metal member is preferably provided with a groove portion in an upper edge of the arm portion adjacent to a base portion of the extending portion for receiving the ear portion of the flat conductive member. Accordingly, the engaging step portion may include the ear portion in a simple shape, thereby easily adapting to the engaging step portion. When the ear portion is accommodated in the groove portion, the ear portion is stably held and contacts with the front surface of the extending portion over a relatively large contact area.

In the present invention, the extending portion an end surface of a distal end thereof in the extending direction, and the end surface preferably includes a regulating surface in parallel to the side end surface of the flat conductive member. Accordingly, even when the flat conductive member is not provided with the engaging step portion such as the ear potion, with the regulating surface, it is possible to position the flat conductive member in a width direction thereof, i.e., the direction that the terminals are arranged, so that the flat conductive member is accurately placed on the contact portion of the terminals in the width direction.

As described above, the housing is provided with the metal member, and the extending portion extends from the arm portion of the metal member for engaging the side edge portion of the flat conductive member. Due to a high strength of the metal member, it is possible to withstand an inadvertent pullout force of the flat conductive member with a small size of the metal member, thereby reducing the size of the connector in the direction that the terminals are arranged.

DESCRIPTION OF THE PREFERRED EMBODIMENTS

Hereunder, embodiments of the present invention will be explained with reference to the accompanying drawings.

Figure 1:
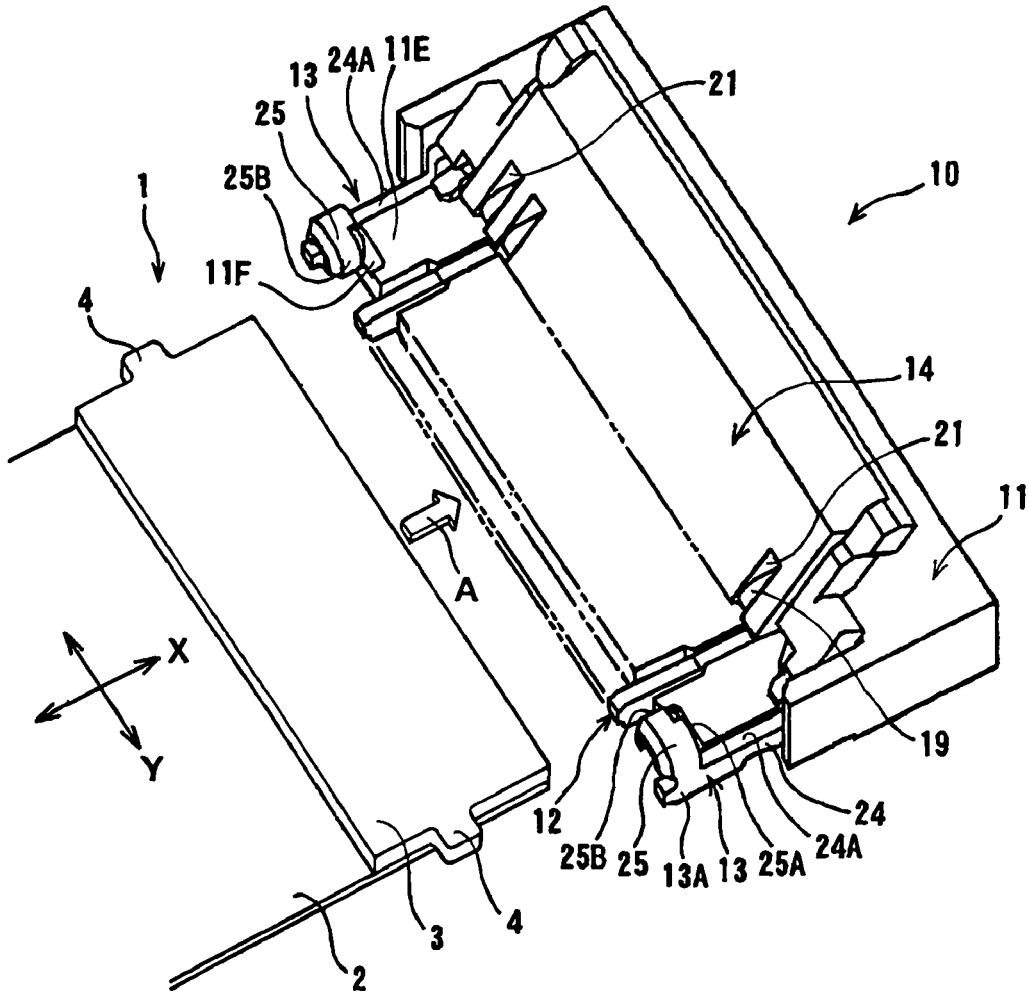
FIG. 1 is a perspective view showing an electrical connector in a state that a pressing member is situated at an open position before a flat conductive member is inserted according to an embodiment of the present invention.
Figure 2:
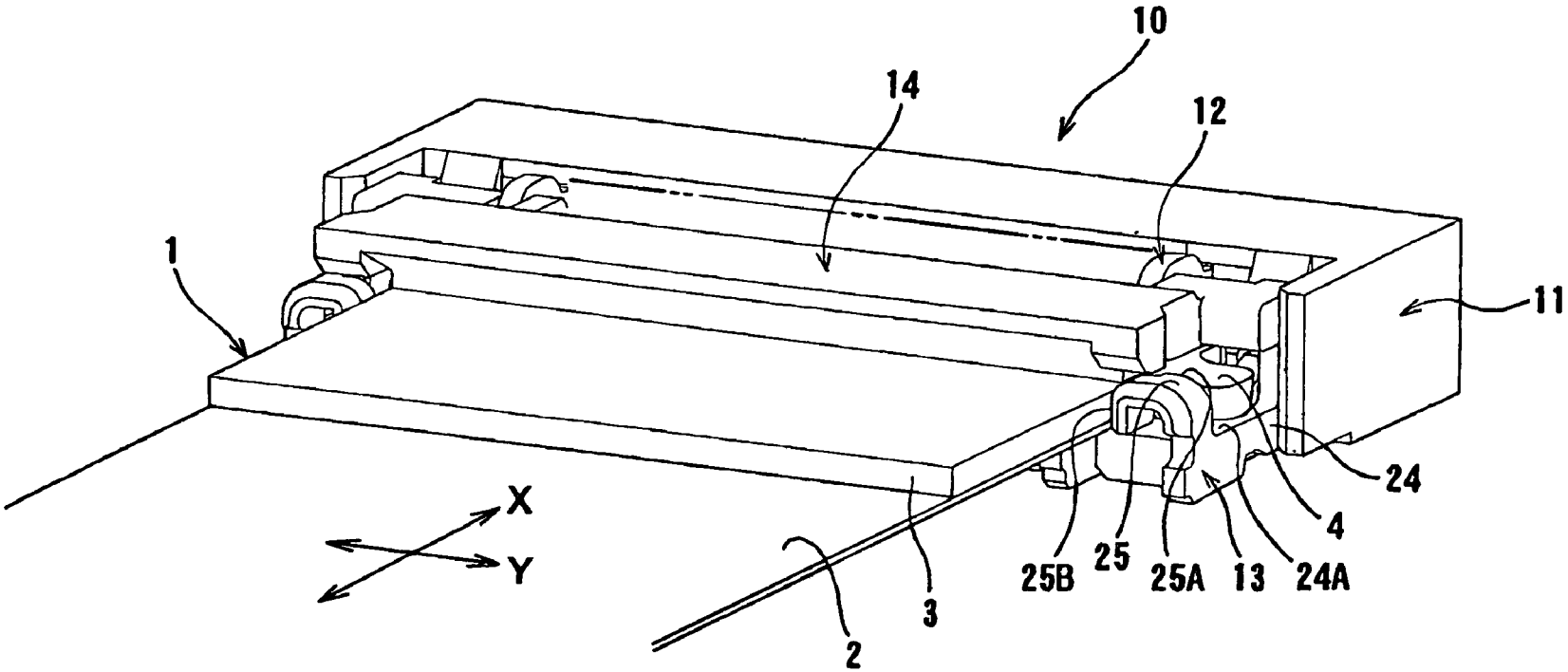
FIG. 2 is a perspective view showing the electrical connector shown in FIG. 1 in a state that the pressing member is situated at a close position after the flat conductive member is inserted.

FIGS. 1 and 2 are views showing a connector in an embodiment. As shown in FIGS. 1 and 2, a flat conductive member 1 is inserted and connected to a front portion of a connector 10 in an arrow direction A. In the flat conductive member 1, a plurality of conductive members (not shown) extending in an X direction is arranged next to each other in a Y direction perpendicular to the X direction, and is integrated to form a band cable member 2. Each of the conductive members is exposed from a lower surface of the flat conductive member 1 at an end portion (right end portion) thereof.

In the embodiment, a reinforcement sheet 3 is attached to an upper surface of the flat conductive member 1. Further, the flat conductive member 1 is provided with engaging step portions 4 in an ear shape at both side edges on a distal end side of the reinforcement sheet 3. In FIG. 1, a pressing member 14 (described later) is situated at an opening position, and, in FIG. 2, the pressing member 14 is situated at a close position.

The electrical connector 10 to be connected to the flat conductive member 1 includes a housing 11 formed of an insulative material and arranged above a circuit board (not shown); a plurality of flat terminals 12 arranged and held on the housing 11; metal members 13 attached to the housing 11 and disposed adjacent to ones of the terminals 12 at both side edges thereof in a direction that the terminals 12 are arranged; and a pressing member 14 supported on the terminals 12 and the housing 11 to be freely rotatable.

Figure 3:
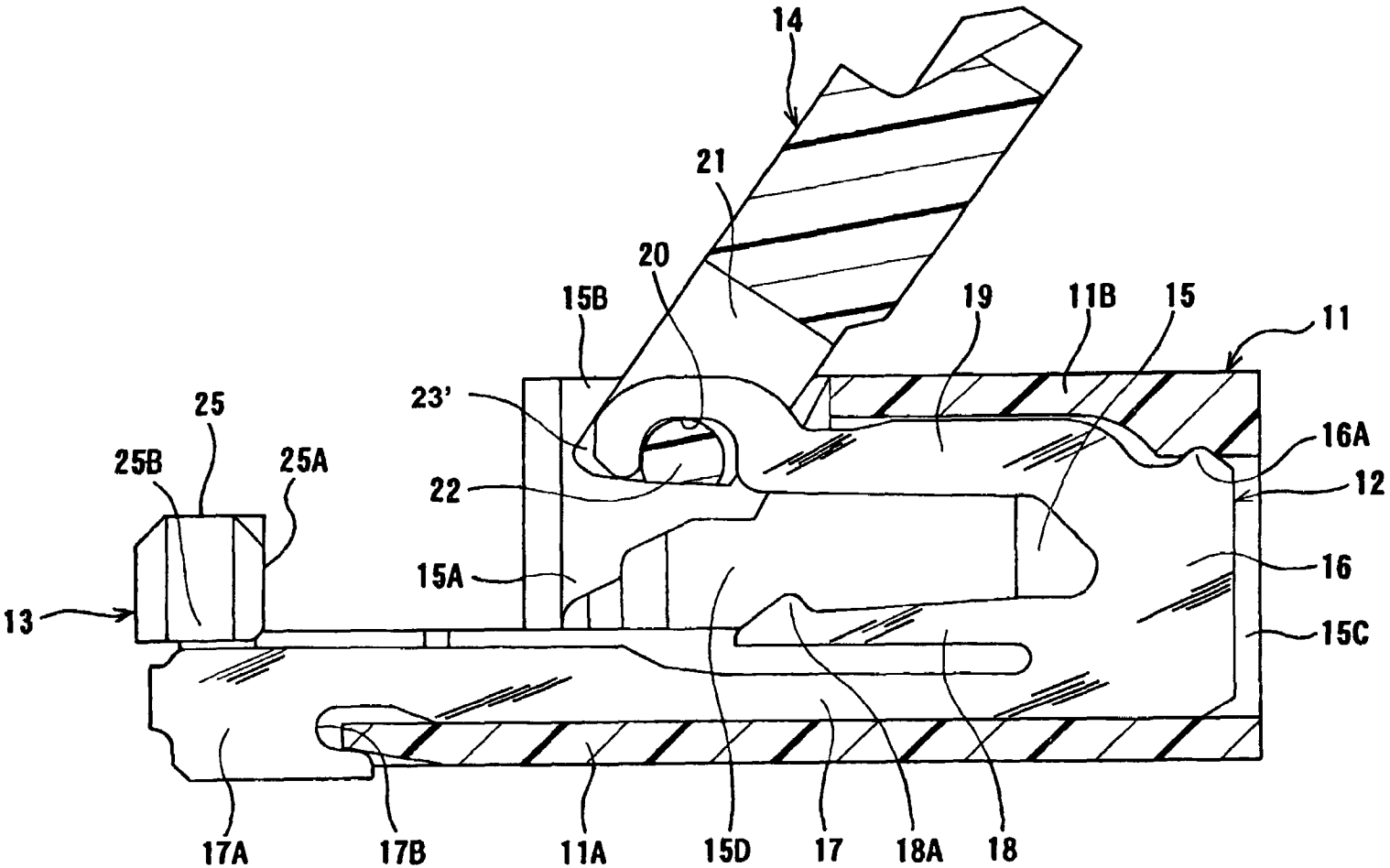
FIG. 3 is a sectional view of the electrical connector taken along a surface in parallel to a terminal of the connector shown in FIG. 1 in the state that the pressing member is situated at the open position.
Figure 4:
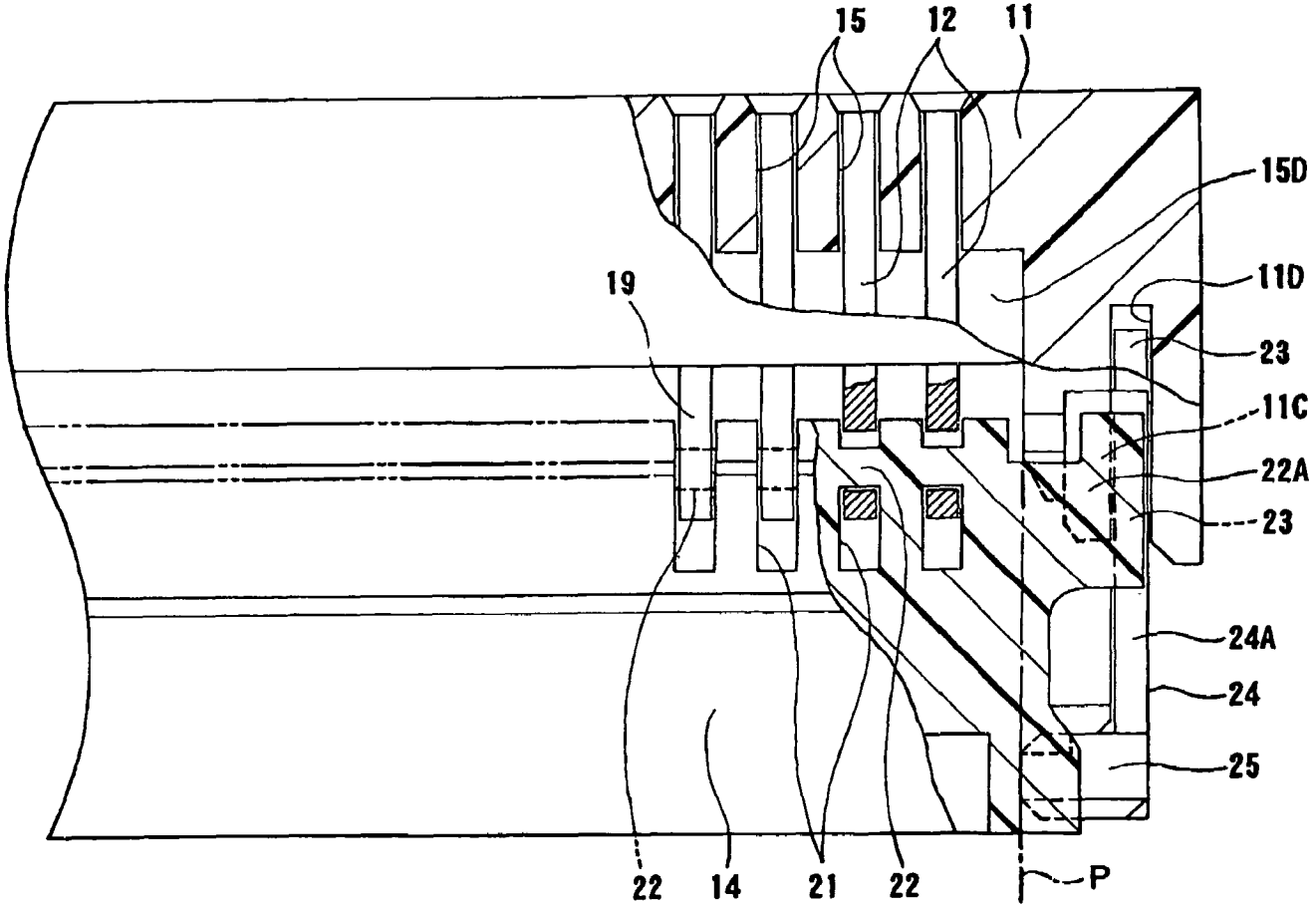
FIG. 4 is a partial sectional view of the electrical connector without the flat conductive member shown in FIG. 1 in the state that the pressing member is situated at the close position.

FIG. 3 is a sectional view showing the electrical connector 10 at a position of the terminals 2, and FIG. 4 is a partially sectional plan view showing the electrical connector 10 with an upper wall 11B of the housing 11 and the pressing member 14 partially sectioned, respectively. As shown in FIGS. 3 and 4, the housing 11 is provided with terminal receptacle grooves 15. The terminal receptacle grooves 15 are formed in a slit shape, and have a width corresponding to a plate thickness of the terminals 12 formed of metal plates. Further, the terminal receptacle grooves 15 extend in a direction in parallel to a sheet surface of FIG. 3, and are arranged at a plurality of positions with a constant pitch therebetween along a direction perpendicular to the sheet surface (refer to FIG. 4).

As shown in FIG. 3, the terminal receptacle groove 15 includes a left opening portion 15A opening to a left hand at a left edge side thereof; an upper opening portion 15B opening upward at a left half thereof; and a right opening portion 15C opening to a right hand at a right edge side thereof. The upper opening portions 15B of the terminal receptacle grooves 15 communicate with each other in a direction perpendicular to the sheet surface.

In the embodiment, each of the terminals 12 retained in the terminal receptacle groove 15 is formed of a metal plate having a flat shape. As shown in FIG. 3, each of the terminals 12 includes an attaching portion 16 fitted into the right opening portion 15C; a connecting arm 17 extending in a direction to a left hand opposite to the attaching arm 16; a contacting arm 18 situated above the connecting arm 17 and extending in parallel to the connecting arm 17; and a supporting arm 19 extending upwardly from the attaching portion 16 and then curing to a left hand.

In the embodiment, each of the terminals 12 is inserted into each of the terminal receptacle grooves 15 from the left side before the metal members 14 is attached. Accordingly, as shown in FIG. 3, the attaching portion 16 enters the right opening portion 15C, so that the terminal 12 does not come off the terminal receptacle groove 16. Further, the connecting arm 17 includes a connecting portion 17A protruding downward at a left side thereof and a fixing groove 17B formed in a right edge of the connecting portion 17A.

When the terminal 12 is inserted into the terminal receptacle groove 15, the fixing groove 17B is fitted into a left side of a bottom surface of the housing 11, so that the terminal 12 does not come off the terminal receptacle groove 15. The connecting portion 17A has a lower edge slightly protruding downward with respect to a bottom surface of a lower wall 11A of the housing 11. Accordingly, it is possible to securely connect to a corresponding circuit portion of the circuit board with solder.

In the embodiment, the contacting arm 18 has a short and small shape. Further, as shown in FIG. 3, the contacting arm 18 has elasticity in a vertical direction, and includes a contacting portion 18A in a protrusion shape at a distal end thereof.

In the embodiment, the supporting arm 19 has an upper edge abutting against an inner surface of an upper wall 11B of the housing 11 for support. A distal end of the supporting arm 19 protrudes forward beyond the upper wall 11B and reaches the upper opening 15B of the terminal receptacle groove 15. The distal end of the supporting arm 19 is formed in an inverted U character shape to form a groove portion as a rotation supporting portion 20 for supporting the pressing member 14. Further, the distal end of the supporting arm 19 is situated in the upper opening portion 15B of the terminal receptacle groove 15, and has elasticity.

The terminal receptacle groove 15 between the contacting arm 18 and the supporting arm 19 extends in a direction perpendicular to the sheet surface of FIG. 3. Further, a receptacle space 15D is provided for inserting the flat conductive member from a left hand.

In the embodiment, the pressing member 14 has a flat plate shape as shown in FIGS. 1, 2, and 4, and a lever shape as shown in FIG. 3. The pressing member 14 has a width sufficiently covering an arrangement range of the terminals 12. As shown in FIG. 3, when the pressing member 14 is situated at the open position, there is a space for inserting the flat conductive member 1 into the electrical connector 10 through the left opening portions 15A, so that the front edge (connecting portion) of the flat conductive member 1 is situated above the contact portions 18A of the terminals 12.

As shown in FIG. 2, when the pressing member 14 is situated at the close position, the pressing member 14 becomes a horizontal posture. Further, the pressing member 14 is supported with the supporting portions 20 of the terminals 12 to be rotatable between the open position and the close position.

In the embodiment, the pressing member 14 has groove portions 21 having a slit shape at positions corresponding to the terminals 12 along the arrangement direction of the terminals 12, so that the distal end portions of the supporting arms 19 of the terminals 12 enter the groove portions 21. As shown in FIGS. 3 and 4, shaft portions 22 having an island shape are disposed inside the groove portions 21. The shaft portions 22 are accommodated in the rotation supporting portions 20 of the terminals 12 to be rotatable. Further, the pressing member 14 has pressing portions 23' as protruding portions adjacent to the shaft portions 22 for pressing the flat conductive member upon rotating.

In the embodiment, the pressing member 14 is supported to be rotatable not only with the shaft portions 22 but also supporting portions 11C of the housing 11 in sub-shaft portions 22A provided on the both edges (only the right edge side is shown in FIG. 4). At least one of the terminals 12, the housing 11, or the metal member 13 may support the pressing member 14 to be rotatable.

In the embodiment, as shown in the FIGS. 1, 2, and 4, the metal members 13 are attached to the housing 11.

In the embodiment, each of the metal members 13 is formed of a metal plate, and includes an attachment portion 23 to be attached to the housing 11 (shown in FIG. 4), an arm portion 24 extending backward from the attachment portion 23, and a extending portion 25 formed backward from the arm portion 24. The attachment portion 23 extends forward of the arm portion 24. For example, the attachment portion 23 is formed to fit into a corresponding attachment groove 11D of the housing. The corresponding attachment grooves 11D are formed in the housing, so that a thickness between the receptacle space and the corresponding attachment grooves 11D is large enough for maintaining a sufficient strength.

The arm portions 24 extend backward outside the housing 11 from the attachment portions 23 outside of the arrangement range of the terminals 12. The plate surfaces of the arm portions 24 are parallel to side edge surfaces of the flat conductive member and plate surfaces of the terminals 12. The arm portions 24 include groove portions 24A at upper edges thereof next to the extending portions 25. The groove portions 24A have a size large enough to retain the engaging step portions 4 with an ear shape of the flat conductive member 1.

As shown in FIGS. 1 and 2, the extending portions 25 are curved toward inside of the arrangement range of the terminals 12 after rising from rear edge sides of the arm portions 24. Further, the plate surfaces of the extending portions 25 extend parallel to the surface of the flat conductive member, and distal edge portions of the extending portions 25 curve downward. It is preferred that the distal edge portions are situated within dented portions 11F in a housing upper surface 11E. Accordingly, when the flat conductive member is situated on the housing upper surface 11E, the engaging step portions thereof securely engage the front surfaces of the extending portions 25. As indicated by a projected line P in the FIG. 4, distal edge surfaces (regulating surfaces 25B) of the extending portion 25 in the extending direction thereof are situated at a position substantially same as that of an inner wall surface of the receptacle space 15D contacting with the side edges of the flat conductive member 1 in the extending direction.

When the flat conductive member 1 is inserted in the connector at a correct position, the extending portions 25 are situated to overlap the reinforcement sheet 3 of the flat conductive member 1 in a direction of a thickness of the reinforcement sheet 3. Therefore, when the flat conductive member 1 is inserted into the regular location and the ear-shaped engaging step portions 4 are retained in the groove portions 24A provided in the arm portions 24 of the metal members 13, the back surfaces of the engaging step portions 4 face engaging surfaces 25A or front surfaces of the extending portions 25. Further, the regulating surfaces 25B provided on the distal edge surfaces of the extending portions 25 in the extending direction face the side edge faces of the flat conductive member 1. Fixing portions 13A attached to the circuit board with solder are provided in the lower edges of the metal members 13 from the extending portions 25 and the arm portions 24.

An operation of the connector will be explained next.

(1) First, the connector 10 is placed on the circuit board (not shown) at a specific position. Then, the contacting portions 17A of the terminals 12 are connected to the corresponding circuit portions with solder. Further, the fixing portions 13A of the metal members 13 are fixed to corresponding portions on the circuit board thereof.

The flat conductive member 1 to be connected to the connector 10 is also prepared. The width of the flat conductive member 1 (in the terminal arrangement direction) before attaching the reinforcement sheet 3 is almost the same as a distance between the regulating surfaces 25B of the extending portions 25 of the metal members 13 on the both edges in the terminal arrangement direction. Each of the conductive members is exposed on the lower surface at the end side of the flat conductive member, and the reinforcement sheet 3 is attached on the upper surface to provide the contact portion.

A width of the reinforcement sheet 3 is almost the same as the width of the flat conductive member 1, except that in part the engaging step portions 4 are protruding in an ear shape. When the flat conductive member 1 is inserted into the regular position of the connector, the protruding portions of the engaging step portions 4 reach the groove portions 24A provided in the arm portions 24 of the metal members 13 of the connector, and the engaging step portions 4 have a shape and a size for fitting into the groove portions 24A.

(2) Then, when the pressing members 14 moves to the open position shown in the FIGS. 1 and 3, the left opening portion 15A of the connector widely opens.

(3) Further, the flat conductive member 1 is inserted obliquely from above in the arrow direction A, so that the ear-shaped engaging step portions 4 move over the extending portion 25 of the metal members 13 and fit into the groove portions 24A Once the engaging step portions 4 fit into the groove portions 24A, the cables exposed at the lower surface of the extending portion of the flat conductive member 1 are located on the contacting portions 18A of the terminals 12. At this point, even when the flat conductive member 1 receives a force backward, the flat conductive member 1 does not come off as far as the engaging step portions 4 fit into the groove portions 24A.

(4) When the pressing member 14 rotates to the close position shown in FIG. 2, the pressing portions 23' of the pressing member 14 press the flat conductive member 1 against the terminals 12, so that the contact portions 18A are electrically connected to the flat conductive member 1 with an increased pressing force. At this point, the pressing member 14 is situated close to the upper portion of the flat conductive member 1. Accordingly, the flat conductive member 1 is electrically connected with the connector 10 securely; and the connector 10 does not lift.

(5) In the flat conductive member 1, the rear edges of the engagement step portions 4 face the engaging surfaces 25A, i.e., the plate thickness surfaces of the front edges of the extending portions 25 of the metal members 13, or the rear edges of the groove portions 24A. In a state that the pressing member 14 is situated at the open position and just after the flat conductive member 1 is inserted, even when the flat conductive member 1 is pulled backward, the engaging step portions 4 abut against the plate thickness surfaces of the extending portion 25, thereby preventing the flat conductive member 1 from coming off. Further, the flat conductive member 1 does not move from the regular position, so that the contact portions 18A securely maintain electrical connection with the conductive members of the flat conductive member 1.

Figure 5:
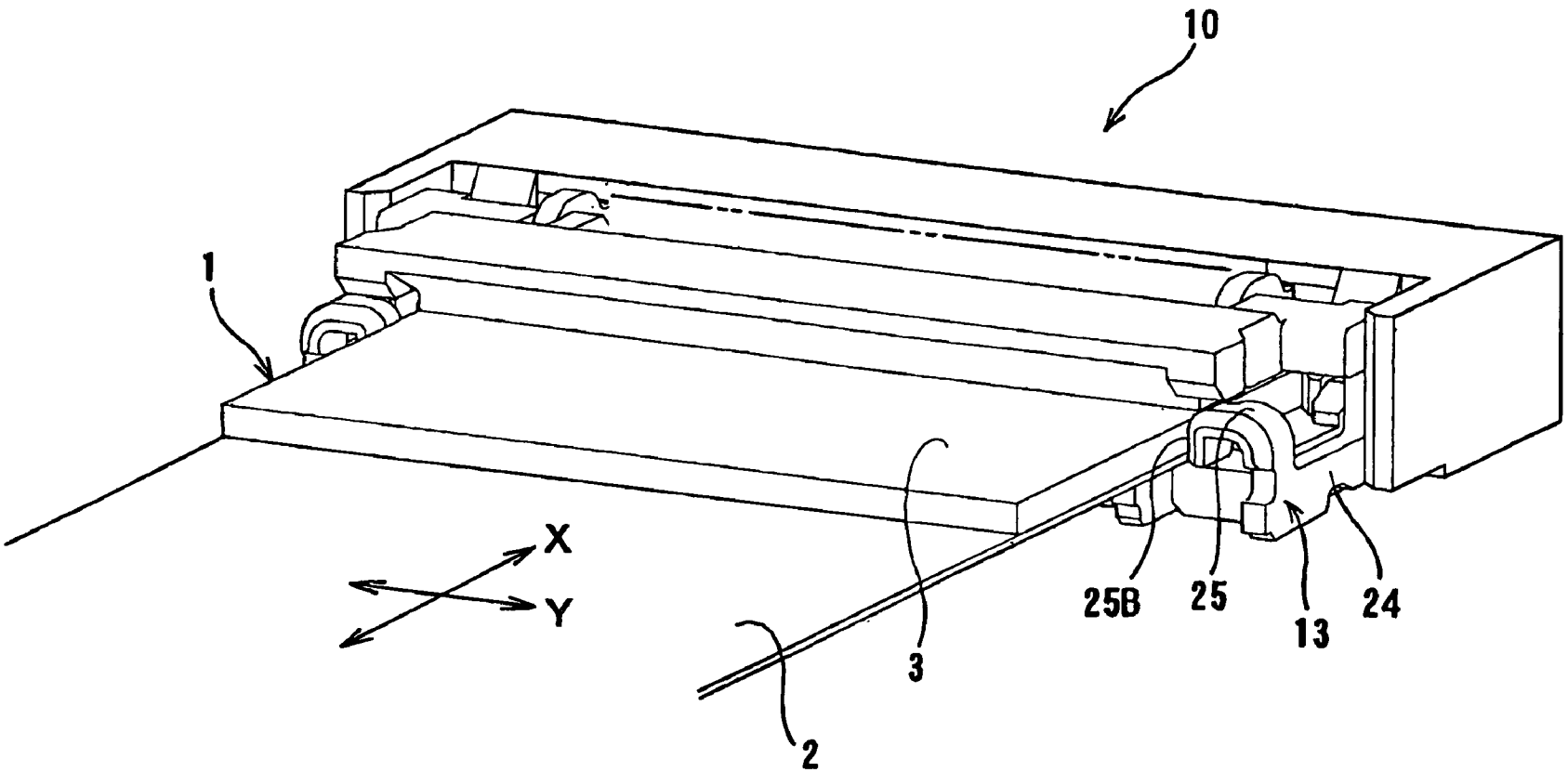
FIG. 5 is a perspective view corresponding to FIG. 2 in a case that the flat conductive member is not provided with an engaging step portion.

(6) The flat conductive member 1 may have the reinforcement sheet 3 without the engaging step portions in an ear-shape or the like. In this case, as shown in FIG. 5, the widths of the flat conductive member 1 and the reinforcement sheet 3 are set to a distance between the extending portions 25 of the metal members 13.

In the case that the flat conductive member 1 has the same width as the distance described above and is not provided with the ear-shaped engagement step portions or the like, when the pressing member 14 is situated at the open position, the flat conductive member 1 is inserted into the connector while the regulating surfaces 25B of the extending portions 25 guide the side edges of the flat conductive member 1 in a regular position in the width direction. Then, the pressing members 14 rotate to the close position shown in FIG. 5 and press the flat conductive member 1 against the terminals 12.

When the width of the flat conductive member 1 is smaller than the distance described above, the width of the reinforcement sheet 3 attached to the flat conductive member 1 may be set to the distance described above. In this case, an engaging step portion with an ear-shape or the like may be attached to the reinforcement sheet to prevent the flat conductive member 1 from coming off. Even when the engaging step portion is not provided, the regulating surfaces guide and position the flat conductive member 1 in the width direction upon insertion.

As described above, the extending portions are effective whether or not the engaging step portions are provided in the flat conductive member.

In the present invention, in addition to the embodiments shown in Figs, various modifications are possible. For example, the engaging step portions of the flat conductive member may be dented portions provided in the side edges of the flat conductive member instead of the ear-shape portions as shown in Figs. It is sufficient to provide a step portion with a rear surface engaging the front surface of the extending portion as the engaging step portion.

The extending portions of the metal members may be made of metal plates as shown in Figs, or made of metal members, as far as the extending portions overlap with the flat conductive member in the direction of the thickness. That is, it is sufficient that the front surfaces of the extending portions face with a back surface of the engaging step portions of the reinforcement sheet attached to the flat conductive member at least partially in the back and front direction.

The extending portions may be formed in a simple plate shape, may have curved distal end portions in the extending direction as shown in Figs, or may have front side edges curved in the extending direction. For example, the distal edges of the extending portions larger than the arm portions and the groove portions in a vertical direction may be curved backward inside the housing, or may be curved toward inside the housing and then curved as the extending portions.

The disclosure of Japanese Patent Application No. 2006-195201, filed on Jul. 18, 2006, is incorporated in the application by reference.

While the invention has been explained with reference to the specific embodiments of the invention, the explanation is illustrative and the invention is limited only by the appended claims.

What is claimed is:

1. An electrical connector to be connected to a flat conductive member having a connecting portion, comprising:

a housing formed of an insulating material and having a receptacle space for receiving the flat conductive member;

a terminal arranged in the housing along a first direction, said terminal including a contact portion for contacting with the connecting portion of the flat conductive member;

a metal member having an arm portion positioned in a side of the housing and an extending portion extended upwardly and curved inward downwardly from an end of the arm portion and situated outside the housing, said extending portion extending close to the flat conductive member and overlapping with the flat conductive member when the flat conductive member is inserted into the receptacle space; and a pressing member attached in a front portion of the housing to be rotatable for pressing the contact portion against the connecting portion;

wherein said extending portion includes an engaging surface extending in parallel to an engaging portion formed in flat conductive member when the flat conductive member is inserted into the receptacle space, and said extending portion includes a regulating surface extending in parallel to a side end surface of an edge of the flat conductive member for engaging the regulating surface with the edge of the flat conductive member when the flat conductive member is inserted into the receptacle space.

2. The electrical connector according to claim 1, wherein said metal member is formed of a metal plate, said arm portion having a plate surface extending in parallel to a side surface of the flat conductive member and said extending portion having a plate surface extending in parallel to the connecting portion of the flat conductive member when the flat conductive member is inserted into the receptacle space.

3. The electrical connector according to claim 1, wherein said metal member further includes a groove portion for receiving an engaging portion formed in the flat conductive member when the flat conductive member is inserted into the receptacle space.

4. The electrical connector according to claim 1, wherein said extending portion includes an upper surface for abutting against a lower surface of the pressing member when the pressing member is situated at a close position.

5. The electrical connector according to claim 1, wherein said extending portion includes a regulating surface situated at a position substantially same as that of an inner surface of the receptacle space.

* * * * *